US008137881B2

(12) United States Patent
Jung et al.

(10) Patent No.: US 8,137,881 B2
(45) Date of Patent: Mar. 20, 2012

(54) ELECTROPHOTOGRAPHIC TONER

(75) Inventors: Moon-il Jung, Suwon (KR); Seung-jin Oh, Seoul (KR); Eun-ha Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 94 days.

(21) Appl. No.: 12/838,833

(22) Filed: Jul. 19, 2010

(65) Prior Publication Data

US 2011/0027713 A1 Feb. 3, 2011

(30) Foreign Application Priority Data

Jul. 28, 2009 (KR) ..... 10-2009-0068962

(51) Int. Cl.
*G03G 9/08* (2006.01)

(52) U.S. Cl. ..... 430/108.1; 430/110.1; 399/252; 977/762

(58) Field of Classification Search ..... 430/108.1, 430/110.1; 399/252; 977/762
See application file for complete search history.

(56) References Cited

U.S. PATENT DOCUMENTS

2011/0200927 A1* 8/2011 Jung et al. ..... 430/105

FOREIGN PATENT DOCUMENTS

JP 2007-219103 8/2007

* cited by examiner

*Primary Examiner* — Mark A Chapman
(74) *Attorney, Agent, or Firm* — Staas & Halsey LLP

(57) ABSTRACT

The disclosure provides an electrophotographic toner including a binder resin; and a light absorber, wherein the light absorber includes a metal nanorod and a surfactant covering a surface of the metal nanorod.

16 Claims, 5 Drawing Sheets

ELECTROPHOTOGRAPHIC TONER

CROSS-REFERENCE TO RELATED PATENT APPLICATION

This application claims the benefit of Korean Patent Application No. 10-2009-0068962, filed on Jul. 28, 2009, in the Korean Intellectual Property Office, the disclosure of which is hereby incorporated by reference in its entirety for all purposes.

TECHNICAL FIELD

The present disclosure relates to toner used to form an image in an image forming apparatus using an electrophotographic method.

BACKGROUND OF RELATED ART

In an image forming apparatus using electrophotographic methods, toner may be supplied to an electrostatic latent image formed on an image receptor so as to form a visual toner image. The visual toner image may be transferred onto a sheet, and the image may be fused onto the sheet using a fusing device that uses heat or pressure. The fusing device may use a fusing nip, which may be formed by engaging a heating roller or a heating belt with a pressuring roller. A sheet may be passed through the fusing nip so that toner may be melted and fused onto the sheet. Alternatively, the fusing device may use light from a light source, which is directly emitted to a sheet so that toner may be melted and fused onto the sheet.

The fusing performance of the toner may be closely related to the heat absorbance of the toner. For example, when the toner is fused using a light source as a heater, the absorbance of the toner with respect to optical energy affects the fusing performance of the toner. That is, as the optical absorbance of the toner increases, the warm-up time may be reduced, and power consumption of the image forming apparatus may also be reduced.

In order to increase the optical absorbance of the toner, a light absorber may be added to the toner. However, a general light absorber absorbs some of the light having wavelengths in the visible ray range, thereby adversely affecting the reproducibility of color of the toner. Thus, there remains a need in the art for new and improved electrographic toners having improved optical properties.

SUMMARY OF THE DISCLOSURE

Aspects of the present disclosure provides an electrographic toner having improved optical absorbance by which the wavelength of absorbed light may be selected.

According to one aspect of the present disclosure, there may be provided an electrophotographic toner including a binder resin and a light absorber. The light absorber may include a metal nanorod and a surfactant covering the surface of the metal nanorod.

The light absorber may be on the surface of the binder resin or may be inside of the binder resin.

The surfactant may be dissolved in an organic solution or in an aqueous solution having a polarity equal to or greater than 1.8.

The surfactant may comprise methoxy polyethyleneglycol-thiol (mPEG-SH) or polyvinyl pyrrolidone (PVP).

the metal nanorod may comprise silver (Ag), gold (Au), platinum (Pt), palladium (Pd), iron (Fe), nickel (Ni), aluminum (Al), antimony (Sb), tungsten (W), terbium (Tb), dysprosium (Dy), gadolinium (Gd), europium (Eu), neodymium (Nd), praseodymium (Pr), strontium (Sr), magnesium (Mg), copper (Cu), zinc (Zn), cobalt (Co), manganese (Mn), chromium (Cr), vanadium (V), molybdenum (Mo), zirconium (Zr), or barium (Ba).

The metal nanorod may have a light absorption wavelength band belonging to an ultraviolet ray range or an infrared ray range.

The metal nanorod may have a single aspect ratio associated with a resonance wavelength of the metal nanorod that corresponds to any one wavelength belonging to the light absorption wavelength band.

The metal nanorod may comprise at least a first metal nanorod and a second metal nanorod. The first nanorod may have a first aspect ratio and a first resonance wavelength belonging to the light absorption wavelength band. The second metal nanorod may have a second aspect ratio and a second resonance wavelength belonging to the light absorption wavelength band. The second resonance wavelength may be different from the first resonance wavelength.

The metal nanorod may have an aspect ratio in the range of 1 to 100.

The metal nanorod may have a uniform cross sectional shape perpendicular to a major axis of the metal nanorod.

The amount of the light absorber may be in the range of 0.005 wt % to 10 wt %.

The binder resin may have a dielectric constant in the range of 1 to 5.

The binder resin may be a polyester resin, an epoxy resin, a polyamide resin, a styrene-acryl resin, a styrene resin, an acryl resin, a polyester polyol resin, a phenol resin, a silicon resin, a polyvinyl resin, a polyurethane, or a butadiene resin.

According to another aspect of the present disclosure, there may be provided a toner cartridge for use in an electrophotographic image forming apparatus, which may comprise a housing that may accommodate therein toner that may comprise a binder resin; and a light absorber. The light absorber may include a metal nanorod and a surfactant covering a surface of the metal nanorod. The light absorber may be on the surface of the binder resin or is inside of the binder resin.

According to yet another aspect of the present disclosure, an image forming apparatus may be provided to include an image carrier, an image developing unit, a transferring unit and a fusing unit. The image carrier may have a surface on which to support an electrostatic latent image. The image developing unit may be configured to apply toner to the electrostatic latent image on the surface of the image carrier to thereby develop the electrostatic latent image into a toner image. The transferring unit may be configured to transfer the toner image onto a recording medium. The fusing unit may be configured to fix the transferred toner image onto the recording medium. The toner may comprise a binder resin and a light absorber. The light absorber may include a metal nanorod and a surfactant covering a surface of the metal nanorod. The light absorber may be on the surface of the binder resin or is inside of the binder resin.

According to even yet another aspect of the present disclosure, a method of forming an image may be provided to include the steps of attaching a toner to a surface of a photosensitive member on which an electrostatic latent image is formed so as to form a visible image and transferring the visible image onto a transfer medium. The toner may comprise an electrophotographic toner that comprises a binder resin and a light absorber. The light absorber may include a metal nanorod and a surfactant covering the surface of the metal nanorod.

BRIEF DESCRIPTION OF THE DRAWINGS

Various features and advantages of the present disclosure will become more apparent by describing in detail several embodiments thereof with reference to the attached drawings in which.

DETAILED DESCRIPTION OF SEVERAL EMBODIMENTS

Figure 1:
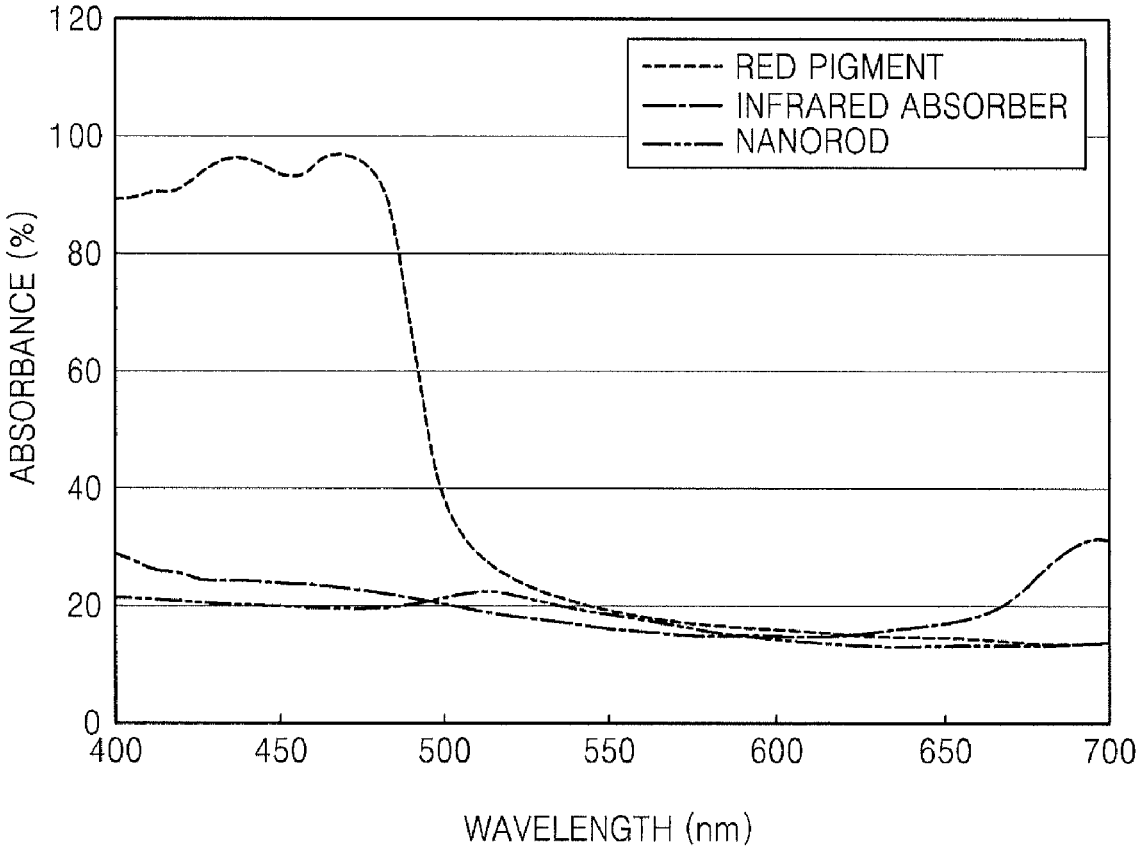
FIG. 1 provides a graph for comparing optical absorbance in the visible ray range with respect to a material added to toner.

The present disclosure will now be described more fully with reference to the accompanying drawings. The disclosure may, however, be embodied in many different forms and should not be construed as being limited to the embodiments set forth herein. Rather, these embodiments are provided so that the disclosure will be thorough and complete and fully convey the concept to those of ordinary skill in the art. In the drawings, the thicknesses of layers and regions may be exaggerated for clarity. Like reference numerals in the drawings denote like elements and thus their description will be omitted.

As used herein, an electrophotographic toner includes a binder resin and a light absorber, wherein the light absorber includes a metal nanorod and a surfactant covering a surface of the metal nanorod. The light absorber may be mixed with the binder resin to be dispersed in the electrophotographic toner or may be added as an external additive to the toner particles during the preparation of the electrophotographic toner. The electrophotographic toner may also include compositions that may be added to a normal toner including but not limited to a colorant, a releasing agent, a charge control agent, or the like. The compositions may also be changed according to the development method.

The metal nanorod may be formed of a metal that may be formed in a bar shape having a nano size. That is, the metal nanorod may be formed of a metal including, but not limited to, silver (Ag), gold (Au), platinum (Pt), palladium (Pd), iron (Fe), nickel (Ni), aluminum (Al), antimony (Sb), tungsten (W), terbium (Tb), dysprosium (Dy), gadolinium (Gd), europium (Eu), neodymium (Nd), praseodymium (Pr), strontium (Sr), magnesium (Mg), copper (Cu), zinc (Zn), cobalt (Co), manganese (Mn), chromium (Cr), vanadium (V), molybdenum (Mo), zirconium (Zr), barium (Ba) and the like, or an alloy thereof.

It is well known that surface plasmon resonance occurs on a surface of a metal nanorod. When surface plasmon resonance occurs on the surface of the metal nanorod, light incident on the metal nanorod may be prevented from being reflected or scattered, and absorption of optical energy of the metal nanorod reaches its peak and photothermal energy conversion may be efficiently carried out.

A wavelength of light absorbed due to surface plasmon resonance may vary according to the configuration and shape of the metal nanorod. In particular, with regard to a metal nanorod having a predetermined diameter, a wavelength range in which light may be absorbed may vary according to the length of a major axis, that is, the aspect ratio of the metal nanorod. For example, the greater the aspect ratio of the metal nanorod, the longer the wavelength of the absorbed light. Accordingly, the metal nanorod may be formed so as to have a predetermined aspect ratio corresponding to a wavelength of light emitted from a light source used when the metal nanorod is fused. For example, the metal nanorod may be formed by putting a salt, such as gold chloride ($HAuCl_4$), in an appropriate solvent to form a metal seed and sufficiently adding cetyl trimethyl ammonium bromide (CTAB), a cationic surfactant, into the solvent. At this point, the aspect ratio of the metal nanorod may be controlled according to the time taken to form the metal nanorod and the concentration of the CTAB. The CTAB may also be replaced with an environmentally compatible surfactant.

In order not to influence the reproducibility of color of the electrophotographic toner, the wavelength range for absorbing light of the metal nanorod may be in the range other than the range of visible rays. That is, the wavelength range for absorbing light of the metal nanorod may be in the range of ultraviolet rays or infrared rays. The aspect ratio of the metal nanorod may be in the range of 1 to 100. If the light source used when the metal nanorod is fused is a single-wavelength source such as a laser, the metal nanorod having a single aspect ratio and using a single wavelength of the light source as a resonance source may be added to the light absorber. For example, a metal nanorod having a diameter of 10 nm and a major axis length of 45 nm may have a resonance wavelength in an ultraviolet ray range of about 850 to about 950 nm. If the light source used when the metal nanorod is fused is a broadband wavelength source such as a xenon lamp, metal nanorods having at least two different aspect ratios and using different wavelengths belonging to a broadband of the light source as respective resonance wavelengths may be added to the light absorber.

The metal nanorod may have a bar shape having uniform cross sections perpendicular to a major axis of the metal nanorod. Alternatively, the metal nanorod may have a dumbbell shape. If the metal nanorod has a dumbbell shape, secondary surface plasmon resonance may occur in a range of visible rays. This secondary surface plasmon resonance deteriorates the reproducibility of the color of the electrophotographic toner. Accordingly, the metal nanorod may preferably have uniform cross sections perpendicular to a major axis of the metal nanorod.

When the metal nanorod is used in the electrophotographic toner, it may be important that the configuration and shape of the metal nanorod be maintained with respect to surface plasmon resonance. When surface plasmon resonance occurs in the metal nanorod, the metal nanorod may selectively absorb incident light having a predetermined wavelength. If the configuration and shape of the metal nanorod are changed, the wavelength of light absorbed by the metal nanorod may be changed. Due to a change in the wavelength of light absorbed by the metal nanorod, the metal nanorod may not absorb the optical energy having a desired wavelength, thereby reducing optical absorption efficiency. For example, a fusing device for fusing a toner to a printing medium may be maintained at about 180° C. in order to fuse a resin that is a primary composite of the toner. At this temperature, it may not be easy to maintain the configuration and shape of the metal nanorod without separate means. In addition, the configuration and shape of the metal nanorod may be changed during the process of preparing the toner.

In addition to the metal nanorod, the electrophotographic toner may further include a surfactant that maintains a stable dispersion state of the metal nanorod in a solvent. The surfactant may include, but is not limited to, an organic solution or an aqueous solution having a polarity equal to or greater than 1.8, in consideration of a solvent, a binder resin, and the like, that may be used during a process of preparing a toner. For example, a gold (Au) nanorod may be covered by CTAB, and the Au nanorod may be stably maintained in a dispersion state in an aqueous solution. However, CTAB contains bromine (Br) that adversely affects the human body. Thus, the CTAB may be replaced with an environmentally compatible surfactant. For example, methoxy polyethyleneglycol-thiol (mPEG-SH) dissolved in toluene having a polarity of 2.3 may be used as the surfactant of the Au nanorod, and thus the Au nanorod may be dissolved in an aqueous solution and an organic solution, thereby simultaneously achieving long-term stability and high optical absorption efficiency. For example, NSON 30-NS850, which is available from Nanopartz, a division of Concurrent Analytical Inc. of Salt Lake City, Utah, U.S.A., may be used in order to stabilize the metal nanorod using mPEG-SH. In addition, polyvinylpyrrolidone (PVP) dissolved in isopropanol having a polarity of 4.3 may be used as the surfactant for the Au nanorod.

The amount of the light absorber may be in the range of 0.005 to 10 wt %. When the amount of the light absorber is equal to or less than 0.005 wt %, there may be a limit in the efficient optical absorption. When the amount of the light absorber is equal to or greater than 10 wt %, the mechanical characteristics of toner may deteriorate, or the dispersion characteristics of the light absorber with respect to the binder resin may deteriorate, thereby reducing optical absorption efficiency.

With regard to surface plasmon resonance of the metal nanorod, it is well known that the resonance wavelength may vary according to the dielectric constant of the material covering the metal nanorod as well as the aspect ratio of the metal nanorod. Thus, the resonance wavelength may vary according to the dielectric constant of the binder resin in which the light absorber including the metal nanorod may be dispersed. In addition, the dielectric constant of the binder resin may, for example, be in the range of 1 to 5.

Various resins may be used as the binder resin used in the electrophotographic toner. The binder resin may include, but is not limited to, a styrene copolymer such as polystyrene, poly-para-chlorostyrene, poly-α-methylstyrene, styrene-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-inden copolymer, styrene-maleate copolymer and styrene-maleate ester, polymethylmethacrylate, polyethylmethacrylate, polybuthylmethacrylate and a copolymer thereof, polyvinyl chloride, polyvinyl acetate, poly ethylene, polypropylene, polyester, poly urethane, polyamide, an epoxy resin, polyvinyl butyral, rosin, modified rosin, a terpene resin, phenolic resin, an aliphatic or cycloaliphatic hydrocarbons resin, an aromatic petroleum resin, chlorinated paraffin, paraffin wax, and the like, and mixtures thereof.

The composite of the binder resin may be uniformly foamed so as to have a uniform dielectric constant or reflectivity. When the composite of the binder resin is uniform, the reproducibility of color of toner increases.

With regard to black-and-white toner, carbon black or aniline black may be used as the colorant. With regard to color toner, the colorant may include carbon black for realizing black, and may further include yellow, magenta and cyan colorants for realizing color. Examples of the yellow colorant may include, but is not limited to, a condensed nitrogen compound, an isoindolinone compound, an anthraquinone compound, an azo metal complex, or allyl imide compound, and the like. In detail, C.I. pigment yellow 12, 13, 14, 17, 62, 74, 83, 93, 94, 95, 109, 110, 111, 128, 129, 147, 168, 180, etc. may be used. Examples of the magenta colorant may include but, is not limited to, a condensed nitrogen compound, an anthraquinone compound, a quinacridone compound, a basic dye rate compound, a naphthol compound, a benzo imidazol compound, a thioindigo compound, or a perylene, and the like. In detail, C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254 may used. Examples of the cyan colorant may include, but is not limited to, a copper phthalocyanine compound and a derivative thereof, an anthraquinone compound, or a basic dye rate compound, and the like. In detail, C.I. pigment blue 1, 7, 15, 15:1, 15:2, 15:3, 15:4, 60, 62, or 66 may be used. The colorant may be used alone or in a mixture of at least two of them, and may be selected in consideration of color, saturation, luminosity, weatherability, dispersibility in toner, etc.

The releasing agent may be appropriately used in order to obtain a high-quality image by protecting a photosensitive medium or preventing deterioration of development characteristics. High-purity solid fatty acid methyl esters may be used as the releasing agent, including, but not limited to, low molecular weight polyethylene, low molecular weight poly propylene, low molecular weight polybutylene, low molecular weight polyolefin, paraffin wax, and a polyfunctional ester compound, and the like.

The charge control agent may be used to stably support toner by an electrostatic force on a developing roller. For example, a negative charge control agent such as chrome-containing azo dyes, or a positive change control agent such as a modified product that may be modified into nigrosine and a fatty acid thereof may be used as the charge control agent.

Figure 2:
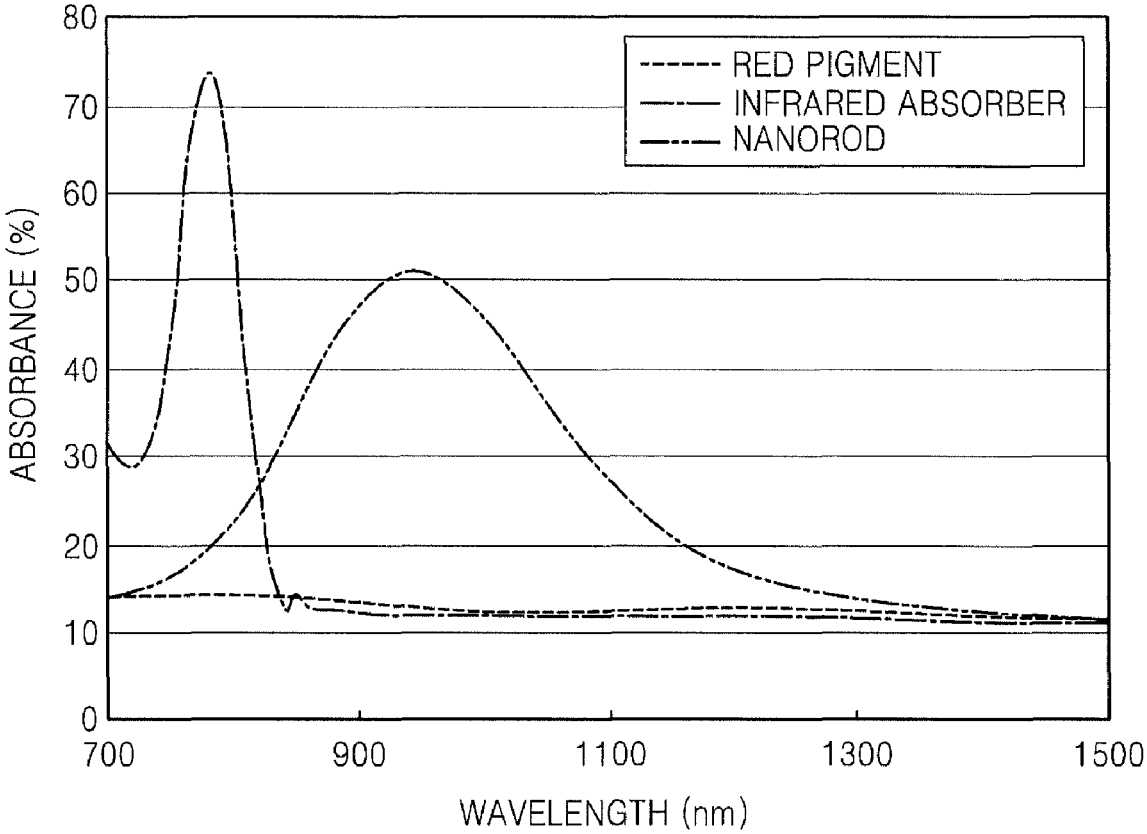
FIG. 2 provides a graph for comparing optical absorbance in the infrared ray range with respect to a material added to toner.

FIGS. 1 and 2 provide graphs for comparing optical absorbance in the visible ray range and the infrared ray range, with respect to the material added to toner. That is, FIGS. 1 and 2 show optical absorbance when a yellow pigment, a general infrared absorber and a nanorod are added to a polyester resin. PROJET 800NP, which is available from Fuji Film Co., may be used as the general infrared absorber, and 1 wt % PROJET 800NP may be added to a resin. NSON 30-NS850, which is available from Nanopatrz, a division of Concurrent Analytical Inc., may be used as the nanorod, and 0.4 wt % of NSON 30-NS850 may be added to the resin.

Referring to FIG. 1, when a nanorod is added to a polyester resin the optical absorbance may be lower in the visible ray range than when a general infrared absorber is added to a polyester resin. In the visible ray range, the optical absorbance of an infrared absorber and an Au nanorod with respect to an optical absorbance of a resin including a yellow pigment are shown in Table 1.

TABLE 1

| | Au nanorod | Infrared absorber |
|---|---|---|
| Optical absorbance of resin containing yellow pigment | 15.3501% | 24.6523% |

As shown in Table 1, the metal nanorod exhibits 38% lower optical absorbance than the optical absorbance of the infrared absorber in the visible ray range that affects the reproducibility of color. Due to the relatively low optical absorbance in the visible ray range, a colorant such as yellow pigment does not affect color of toner, and thus it can be seen that the light absorber using a nanorod has higher reproducibility of color than a general infrared absorber.

FIG. 2 shows that the optical absorbance may be higher and in a wider infrared ray range when a nanorod is added to a polyester resin than when an infrared absorber is added to a polyester resin. The optical absorption of an infrared absorber and an Au nanorod in the infrared ray range are shown in Table 2.

TABLE 2

| | Metal nanorod | Infrared absorber |
|---|---|---|
| Optical absorption in infrared ray range | 9476.9 | 3332 |

As shown in Table 2, in the infrared ray range affecting fusing performance, the Au nanorod exhibits an optical absorption that may be three times higher than that of an infrared absorber. The relatively high optical absorption in the infrared ray range means that the light absorber using nanorod has higher fusing performance than a general infrared absorber.

The electrophotographic toner may be prepared using any methods known in the art including, but not limited to, a pulverization method, a polymerization method, a spray method, and the like. For example, in the pulverization method, the electrophotographic toner may be prepared by melting, mixing and pulverizing the binder resin and light absorber, or if necessary the colorant or other additives and then classifying them so as to obtain particles having a desired diameter. In an emulsion-aggregation method, which may be a type of polymerization method, the electrophotographic toner may be prepared by preparing a resin dispersion solution by using emulsion-aggregation, preparing a colorant solution, in which a colorant is dispersed in a solvent, mixing the resin dispersion solution and the colorant solution so as to form an aggregated substance corresponding to the diameter of the electrophotographic toner and heating and fusing the aggregated substance. The light absorber may be added by mixing the light absorber to a resin dispersion solution, or mixing the light absorber to a colorant dispersion solution. In a suspension-polymerization method, a polymerized toner that is a colored polymerized particle having a desired diameter may be prepared by preparing a polymerization monomer composition and then performing suspension-polymerization with respect to the polymerization monomer composition. For example, when the polymerization monomer composition is prepared by uniformly melting and dissolving a colorant or a polymerization initiator, or if necessary, various additives such as a cross-linking agent and an antistatic agent in a polymerization monomer, the light absorber may be dispersed. In addition, after a toner particle is formed, an external additive may be added.

Figure 3:
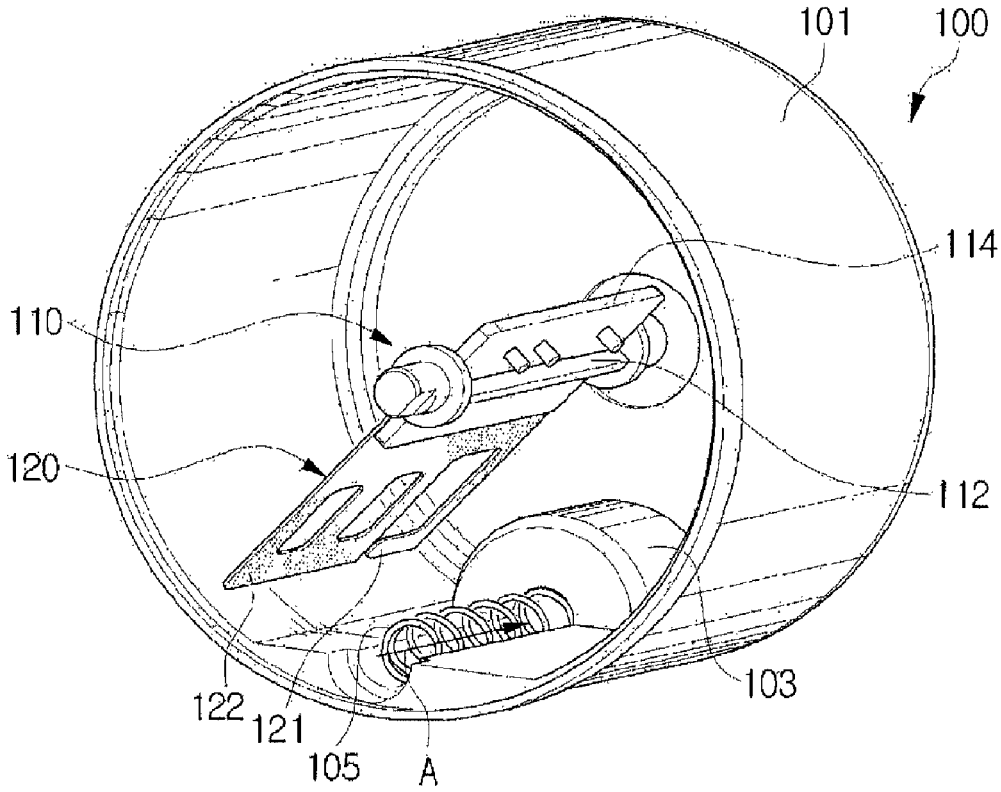
FIG. 3 provides a schematic diagram of a cartridge for accommodating an electrophotographic toner.

FIG. 3 provides a schematic diagram of an example cartridge 100 for accommodating the electrophotographic toner according to one or more embodiments of the present disclosure. Referring to FIG. 3, the cartridge 100 may include a toner tank 101, a supplier 103, a toner-moving member 105 and a toner-stirring member 110. The toner tank 101 may have a hollow cylindrical shape, and may accommodate the electrophotographic toner. The supplier 103 may be installed inside the toner tank 101, and may discharge the electrophotographic toner accommodated in the toner tank 101 to the outside. A toner outlet (not shown) for discharging toner may be formed in an outer circumferential surface of the supplier 103. The toner-moving member 105 may be installed in a lower portion of the toner tank 101 to be at one end of the supplier 103. The toner-moving member 105 may be an auger that may be molded in a continuous wing shape, and one end of the toner-moving member 105 extends inside the supplier 103. Thus, when the toner-moving member 105 rotates, the electrophotographic toner of the toner tank 101 may be moved into the supplier 103, that is, in a direction A for supplying the electrophotographic toner. The electrophotographic toner moved by the toner-moving member 105 may be discharged to the outside via the toner outlet. The toner-stirring member 110 includes a rotation axis 112 and a toner-stirring film 120, and may be rotatably installed in the toner tank 101, so that the electrophotographic toner accommodated in the toner tank 101 may be moved downwards. A wing plate 114 may be formed on the rotation axis 112 so as to easily install the toner-stirring film 120. The toner-stirring film 120 may include a first stirring unit 121 and a second stirring unit 122 that may be formed by removing predetermined portions from the toner-stirring film 120.

Figure 4:
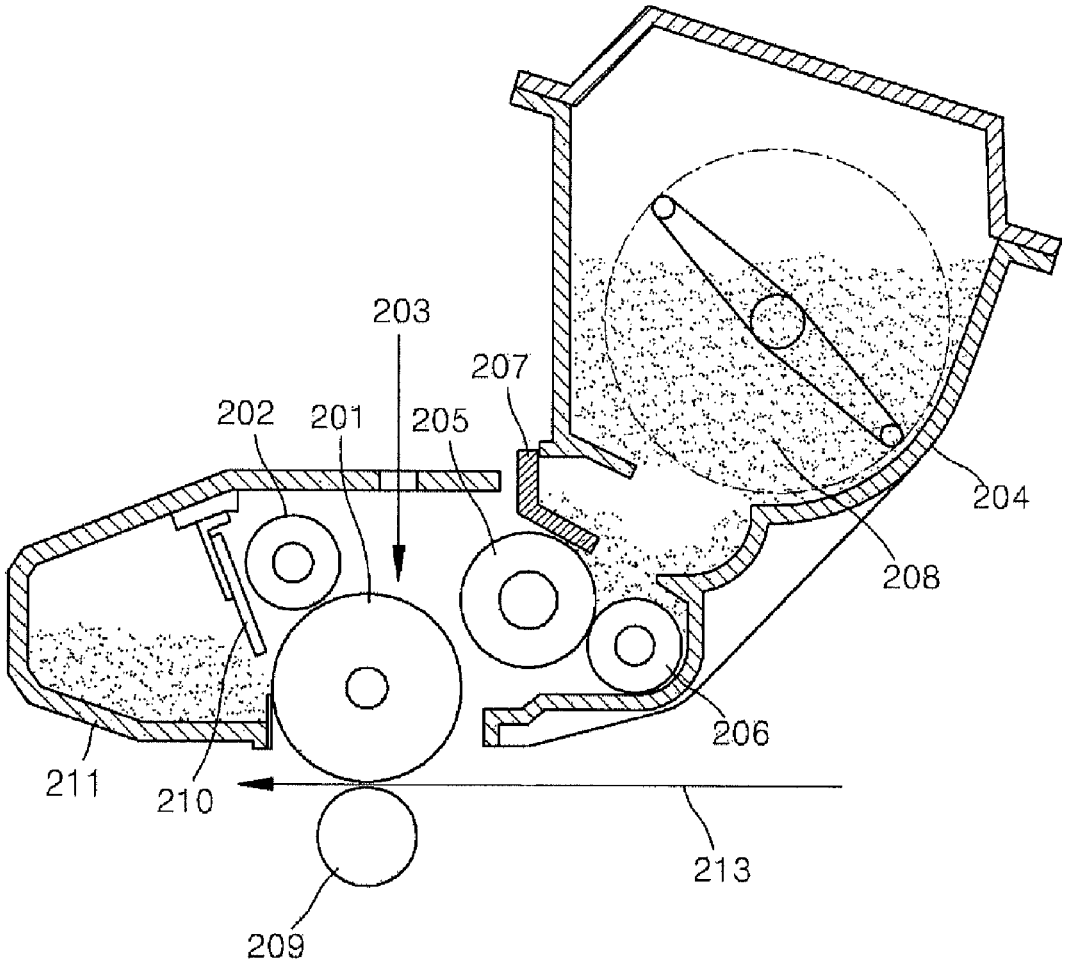
FIG. 4 provides a cross-sectional view of a developing apparatus accommodating a toner.

FIG. 4 provides a cross-sectional view of an example developing apparatus accommodating a toner 208 according to one or more embodiments of the present disclosure. Referring to FIG. 4, the developing apparatus may include a photosensitive drum 201, a charge roller 202, a developing roller 205, a toner-supplying roller 206 and a toner layer regulator 207. The photosensitive drum 201 is an example of an image carrier on which an electrostatic latent image may be formed, and includes a photosensitive layer formed of a photosensitive material on an external surface of a metallic drum, or in the alternative a photosensitive belt having a belt shape may be used as the image carrier. The charge roller 202 is an example of a charger for charging the surface of the photosensitive drum 201 while rotating and being in contact with the photosensitive drum 201. A charge bias may be applied to the charge roller 202. A corona charger (not shown) may be used instead of the charge roller 202.

The surface of the photosensitive drum 201 may be charged with a predetermined voltage by the charge roller 202. An electrostatic latent image may be formed by light 203 emitted from a light-scanning unit (not shown) on the charged surface of the photosensitive drum 201. The toner 208 accommodated in a housing 204 may be supplied to the surface of the developing roller 205 by the toner-supplying roller 206. The toner 208 supplied to the surface of the developing roller 205 may be thinned to a uniform thickness by the toner layer regulator 207, and simultaneously may be rubbed by the developing roller 205 and the toner layer regulator 207 to be charged in a predetermined polarity. The toner 208 may be moved towards the surface of the photosensitive drum 201 by the developing roller 205 that rotates while being spaced apart from the photosensitive drum 201 by a predetermined distance. At this point, the toner 208 may be moved by a voltage difference between the electrostatic latent images formed on the surface of the photosensitive drum 201 and the developing roller 205. The toner 208 that has moved towards the surface of the photosensitive drum 201 may become attached to the electrostatic latent image, and thus the electrostatic latent image may be developed into a visible toner image. The visible toner image formed on the surface of the photosensitive drum 201 may be transferred onto a recording medium 213 by a transfer roller 209 or by an intermediate transfer member (not shown). A portion of the toner 208, which accumulates on the surface of the photosensitive drum 201 after the image is transferred, may be removed by a cleaning blade 210, and may be stored in a waste storage unit 211.

Figure 5:
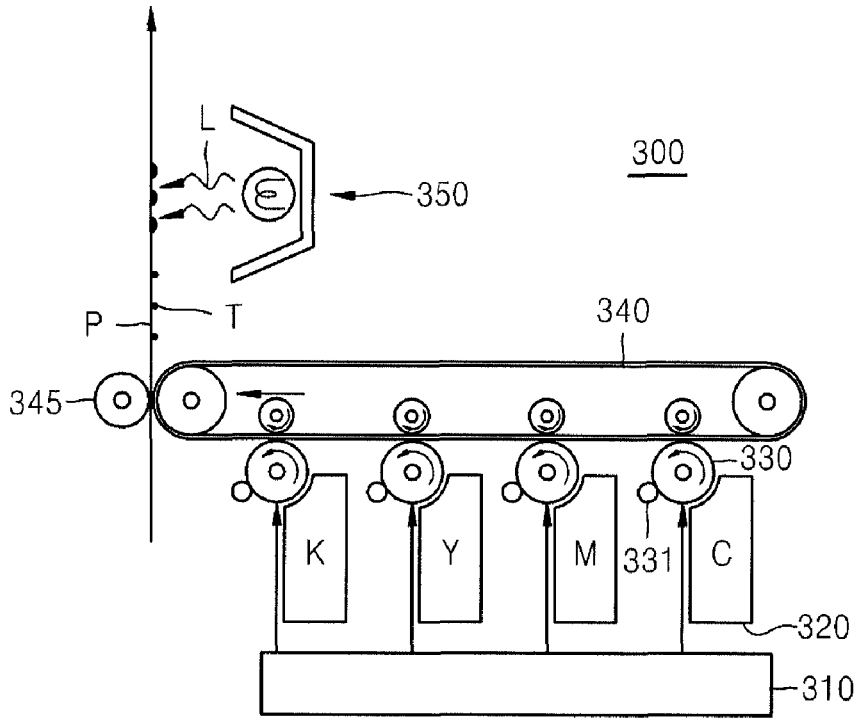
FIG. 5 provides a schematic diagram of an image forming apparatus using a toner.

FIG. 5 provides a schematic diagram of an example of an image forming apparatus 300 using a toner according to one or more embodiments of the present disclosure. Referring to FIG. 5, the image forming apparatus 300 may include a light-scanning unit 310, four toner-supplying units 320, four photosensitive drums 330, four charge rollers 331, an intermediate transfer belt 340, a transfer roller 345 and a fusing unit 350. In order to print a color image, the light-scanning unit 310, the four toner-supplying units 320 and the photosensitive drums 330 may be provided for each color. The light-scanning unit 310 may be a device that scans light that is modulated according to the image information onto the four photosensitive drums 330. The four toner-supplying units 320 may include the housing 204, the toner-supplying roller 206 and the developing roller 205, which are illustrated in FIG. 4. The light-scanning unit 310 scans four light beams onto the four photosensitive drums 330, respectively. As a result, electrostatic latent images corresponding to image information of black (K), magenta (M), yellow (Y) and cyan (C) colors may be formed on the four photosensitive drums 330. The four toner-supplying units 320 supply toners of K, M, Y and C colors respectively to the four photosensitive drums 330 to realize toner images of K, M, Y and C colors. Toner images of K, M, Y and C colors formed on the four photosensitive drums 330 may be transferred onto the intermediate transfer belt 340. The toner images may then be transferred on a recording medium (P) as it is moved between the transfer roller 345 and the intermediate transfer belt 340 by a transfer bias voltage applied to the transfer roller 345.

The fusing unit 350 includes a light source irradiating a light beam L onto the recording medium P on which the toner image may be transferred. An image may be formed by melting and fusing a toner T, which forms the toner image, with the light beam L emitted from the transfer roller 345. The light source of the fusing unit 350 may emit light in a range other than the visible ray range, that is, light in the ultraviolet ray range or the infrared ray range, for example. In this case, the material and aspect ratio of the metal nanorod may be determined so that the light absorber added to the toner T absorbs light in the ultraviolet ray range or the infrared ray range.

A xenon lamp that emits a large amount of light for a short period of time may be used as a light source of the fusing unit 350. The xenon lamp may emit light having a wideband wavelength range, in particular, light in the infrared ray range. In this case, the toner may include a light absorber to which metal nanorods having at least two different aspect ratios are added. At this point, the aspect ratios of the metal nanorods may be determined so that resonance wavelengths of the metal nanorods may be in a wideband wavelength range of the light source.

If a light source, such as a light emitting diode or a laser diode, which emits light having a narrow-band wavelength or a single-wavelength is used as the light source of the fusing unit 350, the toner to which metal nanorod having a single aspect ratio is added may be used, wherein metal nanorod uses light emitted by the light source as a resonance wavelength.

Figure 6:
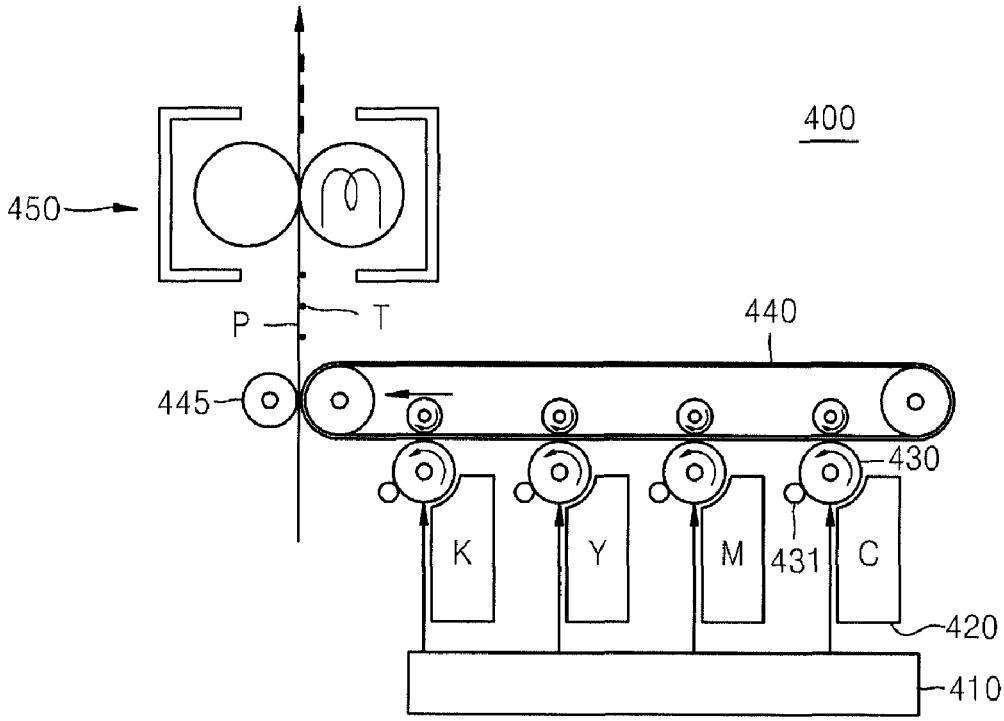
FIG. 6 provides a schematic diagram of an image forming apparatus using a toner.

The toner may be used in another image forming apparatuses as well as an in image forming apparatus using a flash fusing method. For example, FIG. 6 provides a schematic diagram of an image forming apparatus 400 that forms images using toner. Referring to FIG. 6, the image forming apparatus 400 may include a light-scanning unit 410, four toner-supplying units 420, four photosensitive drums 430, four charge rollers 431, an intermediate transfer belt 440, a transfer roller 445 and a fusing unit 450. The fusing unit 450 may include a heating roller and a pressurizing roller, which are engaged with each other to constitute a fusing nip. All the elements of the image forming apparatus 400, except the fusing unit 450, are substantially the same as those of the image forming apparatus 300 of FIG. 5.

The fusing nip of the fusing unit 450 may be normally maintained at a fusing temperature of 170° C. In a toner, a general binder resin such as a polyester resin may be used. The melting temperature of a material of the general binder resin may be lower than 170° C., and thus the general binder resin may be melted and fused while being heated and pressed onto the recording medium P.

An image forming method using toner according to embodiments of the present disclosure may include attaching the toner to a surface of a photosensitive member on which an electrostatic latent image is formed to thereby develop the electrostatic image into a visible toner image and transferring the visible toner image onto a transfer medium. For example, the image forming method may be performed using the image forming apparatus 300 or 400 of FIG. 5 or 6. The image forming method may include charging, exposing, developing, transferring, fusing, cleaning and antistatic operations, and may further include several additional operations for forming an image onto a recording medium.

In the charging operation, the photosensitive member may be charged to a desired polarity that may be negative or positive, as performed by a corona roller or a charge roller. In the exposing operation, an optical system, typically, a laser scanner or a light emitting diode may be arranged so that the charged surface of the photosensitive member may be selectively discharged in an image-wise manner to thereby form an electrostatic latent image that corresponds to the intended subject image to be formed. An example of electromagnetic emission related to "light" may include infrared ray emission, visible ray emission and ultraviolet ray emission.

In the developing operation, toner particles having an appropriate polarity may be brought into contact with the electrostatic latent image of the photosensitive member, and a developer may be used, wherein the developer may be electrically biased so as to have a potential polarity corresponding to the polarity of the toner particles. The toner particles may be moved to the photosensitive member, and may be selectively attached to the electrostatic latent image by an electrostatic force to thereby form a toner image on the photosensitive member.

In the transferring operation, the toner image may be transferred from the photosensitive member to a subject receptor, for example, onto a sheet of recording medium such as paper, to complete the image forming process. If necessary, an immediate transfer element may be used in order to affect the transfer of the toner image from the photosensitive member as well as in a subsequent transfer of the toner image.

In the fusing operation, the toner image formed on the receptor of the final image, e.g., a sheet of paper, may be heated so that the toner particles may be softened or melted, and thus the toner image may be fused onto the final receptor. Another fusing operation may include fusing toner to the final receptor by heating the toner or fusing under a high pressure without heat.

In the cleaning operation, remnant toner that remaining untransferred on the photosensitive substance may be removed.

In the antistatic operation, the photosensitive member may be exposed to light having a predetermined wavelength band so as to reduce the level of charge thereof to substantially uniform and low value, and thus a remnant material of the previous image may be removed, and a photosensitive substance may be prepared for a subsequent image forming cycle.

According to one or more aspects of the present disclosure, the fusing performance of the toner may be improved by the absorption of light having a predetermined wavelength without affecting the reproducibility of color of the toner.

While the present disclosure has been particularly shown and described with reference to several embodiments thereof, it will be understood by those of ordinary skill in the art that various changes in form and details may be made therein without departing from the spirit and scope of the present disclosure as defined by the following claims and equivalents thereof.

What is claimed is:

1. An electrophotographic toner, comprising a binder resin and a light absorber, wherein the light absorber includes a metal nanorod and a surfactant covering a surface of the metal nanorod.

2. The electrographic toner of claim 1, wherein the light absorber is on the surface of the binder resin or is inside of the binder resin.

3. The electrophotographic toner of claim 1, wherein the surfactant is dissolved in an organic solution or an aqueous solution having a polarity equal to or greater than 1.8.

4. The electrophotographic toner of claim 1, wherein the surfactant comprises methoxy polyethyleneglycol-thiol (mPEG-SH) or polyvinyl pyrrolidone (PVP).

5. The electrophotographic toner of claim 1, wherein the metal nanorod comprises silver (Ag), gold (Au), platinum (Pt), palladium (Pd), iron (Fe), nickel (Ni), aluminum (Al), antimony (Sb), tungsten (W), terbium (Tb), dysprosium (Dy), gadolinium (Gd), europium (Eu), neodymium (Nd), praseodymium (Pr), strontium (Sr), magnesium (Mg), copper (Cu), zinc (Zn), cobalt (Co), manganese (Mn), chromium (Cr), vanadium (V), molybdenum (Mo), zirconium (Zr), or barium (Ba).

6. The electrophotographic toner of claim 1, wherein the metal nanorod has a light absorption wavelength band belonging to an ultraviolet ray range or an infrared ray range.

7. The electrophotographic toner of claim 6, wherein the metal nanorod has a single aspect ratio associated with a resonance wavelength of the metal nanorod that corresponds to any one wavelength belonging to the light absorption wavelength band.

8. The electrophotographic toner of claim 6, wherein the metal nanorod comprises at least a first metal nanorod and a second metal nanorod, the first nanorod having a first aspect ratio and a first resonance wavelength belonging to the light absorption wavelength band, the second metal nanorod having a second aspect ratio and a second resonance wavelength belonging to the light absorption wavelength band, the second resonance wavelength being different from the first resonance wavelength.

9. The electrophotographic toner of claim 1, wherein the metal nanorod has an aspect ratio in the range of 1 to 100.

10. The electrophotographic toner of claim 1, wherein the metal nanorod has a uniform cross sectional shape perpendicular to a major axis of the metal nanorod.

11. The electrophotographic toner of claim 1, wherein an amount of the light absorber is in the range of 0.005 wt % to 10 wt %.

12. The electrophoto graphic toner of claim 1, wherein the binder resin has a dielectric constant in the range of 1 to 5.

13. The electrophotographic toner of claim 1, wherein the binder resin is a polyester resin, an epoxy resin, a polyamide resin, a styrene-acryl resin, a styrene resin, an acryl resin, a polyester polyol resin, a phenol resin, a silicon resin, a polyvinyl resin, a polyurethane, or a butadiene resin.

14. An image forming method, comprising the steps of:

attaching a toner to a surface of a photosensitive member on which an electrostatic latent image is formed so as to form a visible image; and transferring the visible image onto a transfer medium, wherein the toner comprises the electrophotographic toner of claim 1.

15. A toner cartridge for use in an electrophotographic image forming apparatus, comprising a housing accommodating therein toner that comprises a binder resin and a light absorber, wherein the light absorber includes a metal nanorod and a surfactant covering a surface of the metal nanorod, and wherein the light absorber is on the surface of the binder resin or is inside of the binder resin.

16. An image forming apparatus, comprising:

an image carrier having a surface on which to support an electrostatic latent image;

an image developing unit configured to apply toner to the electrostatic latent image on the surface of the image carrier to thereby develop the electrostatic latent image into a toner image;

a transferring unit configured to transfer the toner image onto a recording medium, and a fusing unit configured to fix the transferred toner image onto the recording medium, wherein the toner comprises a binder resin and a light absorber, wherein the light absorber includes a metal nanorod and a surfactant covering a surface of the metal nanorod, and wherein the light absorber is on the surface of the binder resin or is inside of the binder resin.

* * * * *

UNITED STATES PATENT AND TRADEMARK OFFICE

CERTIFICATE OF CORRECTION

PATENT NO. : 8,137,881 B2
APPLICATION NO. : 12/838833
DATED : March 20, 2012
INVENTOR(S) : Moon-il Jung et al.

It is certified that error appears in the above-identified patent and that said Letters Patent is hereby corrected as shown below:

Column 10, Line 62, In Claim 2, delete "electrographic" and insert -- electrophotographic --, therefor.

Column 11, Line 36, In Claim 12, delete "electrophoto graphic" and insert -- electrophotographic --, therefor.

Signed and Sealed this
Twenty-second Day of May, 2012

David J. Kappos

David J. Kappos
*Director of the United States Patent and Trademark Office*